US010107602B2

(12) United States Patent
Rappaport

(10) Patent No.: US 10,107,602 B2
(45) **Date of Patent: *Oct. 23, 2018**

(54) ARROW WITH SHAPE MEMORY SHAFT

(71) Applicant: Mark Rappaport, Escondido, CA (US)

(72) Inventor: Mark Rappaport, Escondido, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/425,138

(22) Filed: Feb. 6, 2017

(65) Prior Publication Data

US 2017/0146327 A1 May 25, 2017

Related U.S. Application Data

(63) Continuation-in-part of application No. 14/942,610, filed on Nov. 16, 2015, now Pat. No. 9,562,752.

(60) Provisional application No. 62/079,806, filed on Nov. 14, 2014.

(51) Int. Cl.
*F42B 6/04* (2006.01)
*F42B 12/74* (2006.01)

(52) U.S. Cl.
CPC ..... *F42B 6/04* (2013.01); *F42B 12/74* (2013.01)

(58) Field of Classification Search
CPC ..... F42B 6/04; F42B 6/06; F42B 6/08
See application file for complete search history.

(56) References Cited

U.S. PATENT DOCUMENTS

| | | | | |
|---|---|---|---|---|
| 3,841,635 | A | 10/1974 | Wilson | |
| 4,234,190 | A | 11/1980 | Airhart | |
| 5,242,323 | A | 9/1993 | Rappaport | |
| 8,012,049 | B1 | 9/2011 | Walterscheid | |
| 8,449,413 | B1 | 5/2013 | Jackson | |
| 8,932,159 | B2 | 1/2015 | Lennon | |
| 8,968,126 | B2 | 3/2015 | Chia | |
| 9,562,752 | B1 * | 2/2017 | Rappaport | F42B 6/04 |
| 2006/0046877 | A1 | 3/2006 | Gajda | |
| 2014/0256479 | A1 | 9/2014 | Bynum, Jr. | |

* cited by examiner

*Primary Examiner* — John Ricci
(74) *Attorney, Agent, or Firm* — The Farrell Law Firm, P.C.; John F. Gallagher, III

(57) ABSTRACT

Provided is an arrow that includes a shaft, a forward tip affixed to a first end of the shaft, a rear tip affixed on a second end of the shaft, and a plurality of fins. The shaft is formed by extruding a flexible shape-retaining plastic, to provide a thin wall that extends an entire length of the shaft and encloses a hollow.

14 Claims, 3 Drawing Sheets

Section A–A′

Section B–B′

ARROW WITH SHAPE MEMORY SHAFT

PRIORITY

This application is a Continuation In Part of U.S. patent application Ser. No. 14/942,610, which was filed with the U.S. Patent and Trademark Office on Nov. 16, 2015, which will issue as U.S. Pat. No. 9,562,752 on Feb. 7, 2017, and which claims priority to U.S. Provisional Application No. 62/079,806 filed with the U.S. Patent and Trademark Office on Nov. 14, 2014, the contents of each of which are incorporated herein by reference.

FIELD OF THE INVENTION

The present invention relates generally to a toy arrow and, more particularly, to a toy arrow formed from a hollow flexible plastic cylinder having a shape memory.

DESCRIPTION OF THE RELATED ART

Numerous types of toy arrows are known in the art. Usefulness and function of the various types of toy arrows is limited by the construction, manner of propulsion and arrangement of the various elements of the arrow.

U.S. Pat. No. 5,242,323 provides an air-pulse powered toy bow and arrow set that includes an a soft arrow with a shaft formed of resilient, flexible foam material, and a rear section of the shaft having an open, axial bore to facilitate sliding the arrow onto a launching tube, which extends into the axial bore. An air gun couples to the tube. When the air gun is cocked and fired, compressed air is delivered to the launching tube, thereby propelling the arrow.

U.S. Pat. No. 3,841,635 provides a toy arrow suction cup tip that allows for releasable attachment to a smooth surfaced target. The tip readily collapses when pinched, making it difficult for a child to grip the tip in the event of an attempt to pull the tip from the shaft.

SUMMARY OF THE INVENTION

The present invention overcomes shortcomings of conventional toy arrows by providing an arrow that includes a shaft, a hollow within the shaft, a forward tip attached to a first end of the shaft, a rear tip attached on a second end of the shaft, and a plurality of fins.

Another aspect provides a toy arrow that includes a forward tip, a rear tip, a bendable shaft consisting of a thin plastic that forms a hollow, and a soft foam, with the thin plastic having a shape memory that returns the shaft to its original shape after bending.

A further aspect provides a toy arrow that includes a shaft including a hollow, a forward tip closing a first end of the shaft, and a rear tip closing a second end of the shaft opposite the first end, wherein the shaft comprises a thin plastic with a shape memory that returns the shaft to its original shape after bending.

BRIEF DESCRIPTION OF THE DRAWINGS

For a better understanding of the invention as well as other objects and further features thereof, reference is made to the following detailed description to be read in conjunction with the accompanying drawings, wherein.

DETAILED DESCRIPTION OF THE PREFERRED EMBODIMENTS

The following detailed description of the preferred embodiments of the invention makes reference to the accompanying drawing(s). In describing the invention, explanation of related functions or constructions known in the art are omitted for the sake of clearness in understanding the concept of the invention, to avoid obscuring the description of the invention with unnecessary detail.

Figure 1:
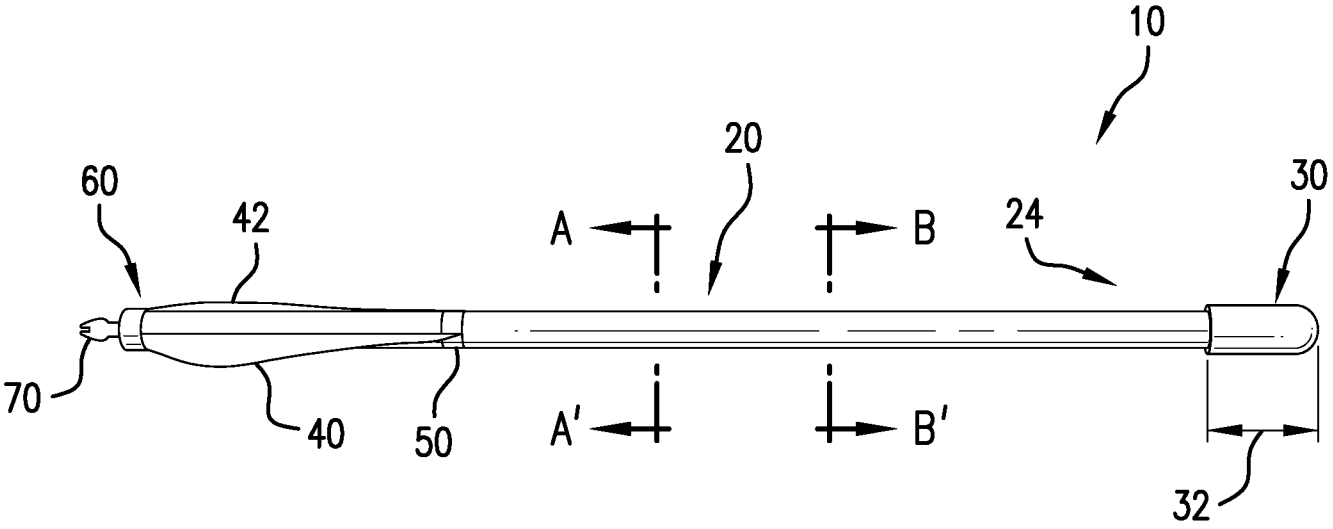
FIG. 1 is a side elevation of an arrow of the present invention.

As shown in the side elevation provided in FIG. 1, arrow 10 includes an elongated shaft 20, which is formed of a thin-wall, flexible plastic having a shape memory. The thin-wall plastic surrounds a hollow 21 that extends an entire length of shaft 20, in a lengthwise direction thereof.

A forward tip 30 formed of soft foam is fixedly attached to a forward end 24 of shaft 20 by bonding agent or by pressure fit to close the forward end 24 of the shaft 20. A tip length 32 is approximately two inches for an arrow of approximately thirty-three inches in length, with a ratio of 1:13 of tip length to overall arrow length.

A forward end of each of the plurality of fins 40, 42, 44 is secured by tape 50 that encircles an outer circumference of shaft 20. A rear tip 60 is provided at an end of shaft 20 opposite the forward end 24, closing the end of shaft 20 opposite the forward end 24.

Figure 2:
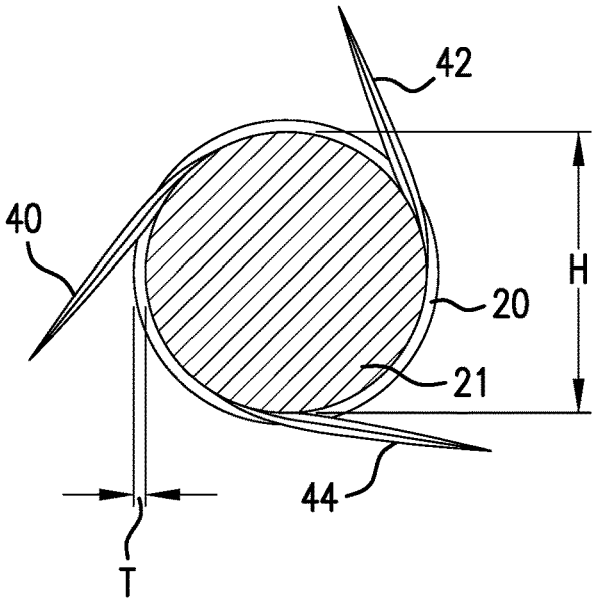
FIG. 2 is a cutaway view of the arrow of FIG. 1, viewed towards a rear end thereof.
Figure 3:
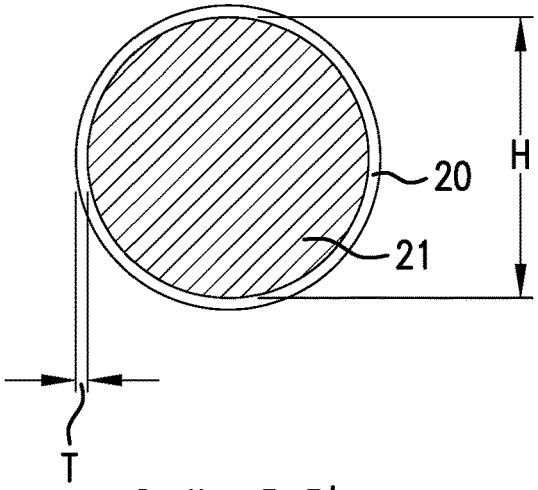
FIG. 3 is a cutaway view of the arrow of FIG. 1, viewed towards a front end thereof.

FIG. 2 is a cutaway view viewed towards a rear end of the arrow of FIG. 1. FIG. 3 is a cutaway view viewed towards a front end of the arrow of FIG. 1.

FIGS. 2 and 3 show inner and outer walls of shaft 20, illustrate a thickness T of shaft 20, and illustrate a relative size H of hollow 21 of shaft 20. FIG. 2 shows a portion of the rear tip 60 and FIG. 3 shows a portion of forward tip 30.

FIGS. 1 and 2 show the plurality of fins 40, 42, 44 provided adjacent to the rear end of arrow 10. Fins 40, 42, 44 create drag during flight of the arrow 10. Fins 40, 42, 44 are lighter in weight than forward tip 30, to avoid changing the center of gravity of arrow 10. Fins 40, 42, 44 extend from an outer circumference of the arrow 10 to create drag during flight of the arrow 10.

The shaft 20 in FIGS. 1-3 is formed of a bendable extruded flexible plastic with a shape memory. When arrow 20 is bent, the shape memory returns arrow 20 to its original shape after bending. The shaft 20 is approximately one inch in diameter. The shaft 20 is formed of plastic of approximately 0.3-0.5 mm thickness, thereby providing an oversized shape-retaining tube. The plastic is extruded into a tube shape, or is provided as a sheet and rolled into a tube shape.

As shown in FIG. 1, a nock 70 is provided in a center of the rear tip 60. The rear tip 60 and the nock 70 are formed of a rigid plastic. The nock 70 receives a bowstring of a conventional bow, which applies a force to propel the arrow 10 from the bow.

Figure 4:
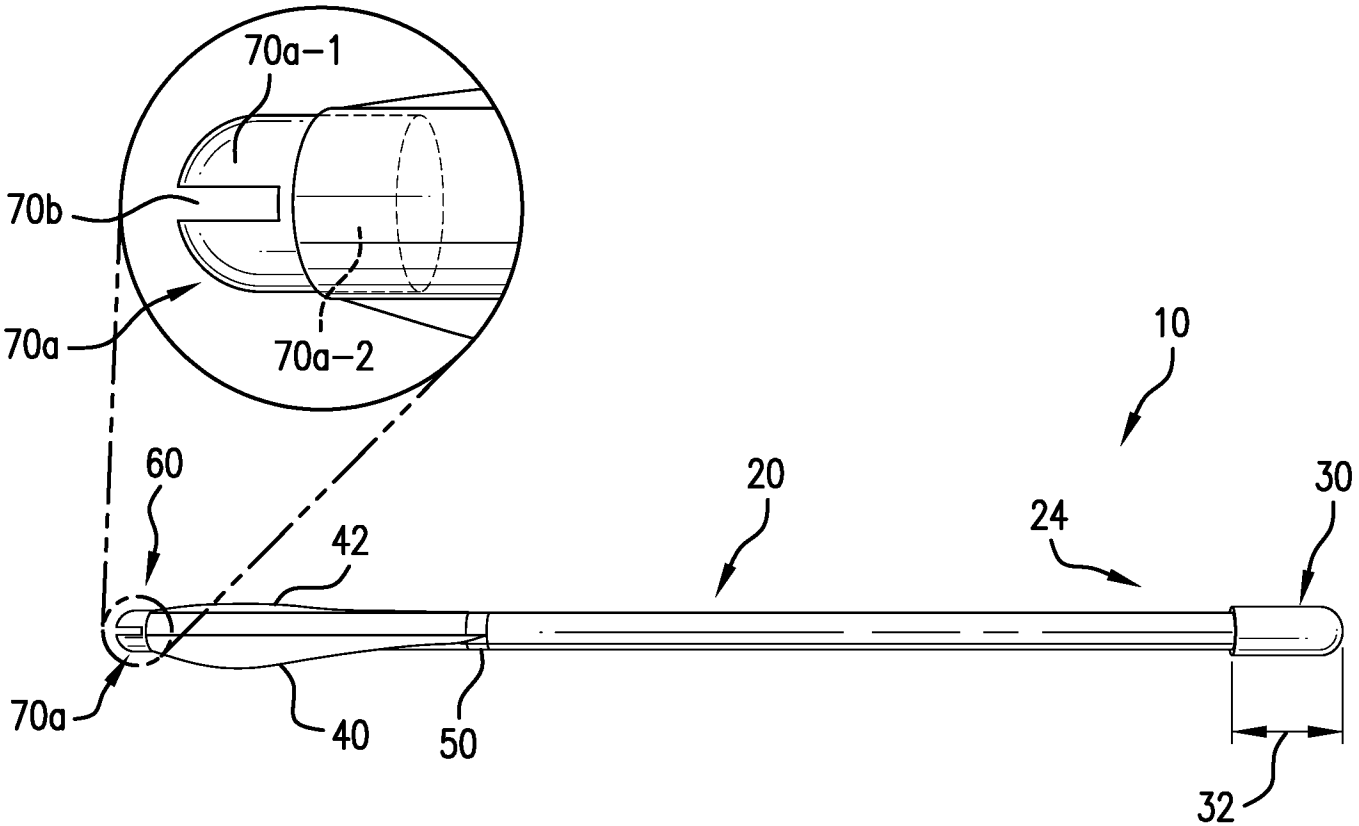
FIG. 4 is a side elevation of an arrow of another embodiment of the present invention.

FIG. 4 is a side elevation of an arrow of another embodiment of the present invention. FIG. 4, shows an alternative nock 70*a* provided in the rear tip 60. The nock 70*a* has a first portion 70*a*1 that extends outward from the rear tip 60, and is shaped as a half circle with a slit 70*b* extending transversely through the half-circle to receive a bowstring of a conventional bow. The alternative nock 70*a* has a cylindrically shaped second portion 70*a*2 that extends into the shaft 20. The diameter of the cylinder of the second portion 70*a*2 is slightly larger than an interior diameter of the shaft 20, allowing the nock 70*a* to plug the rear end of the shaft 20. The nock 70*a* is preferably formed of flexible plastic with sufficient rigidity to maintain the bowstring within the slit 70*b*.

The oversized shape-retaining tube of the shaft 20 provides lengthwise rigidity and maintains shape when the bowstring pushes on nock 70 to propel arrow 10 from the bow. That is, the rigidity of elongated shaft 20 avoids buckling of arrow 10 from the force exerted when the bowstring launches the arrow 10.

The oversized shape-retaining tube of the shaft 20 requires less power to launch arrow 10 at a higher rate of speed than needed to launch a conventional arrow, with the hollow 21 reducing the weight of the arrow 10.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed:

1. An arrow comprising:
a shaft;
a hollow within the shaft;
a forward tip attached to a first end of the shaft;
a rear tip attached on a second end of the shaft; and
a protrusion extending forward of the forward tip and rearward to overlap a portion of the shaft extending rearward of the forward tip,
wherein the rear tip comprises a nock that spans a diameter at the second end of the shaft.

2. The arrow of claim 1, wherein the hollow extends from the forward tip to the rear tip.

3. The arrow of claim 1, wherein the hollow occupies a majority of the diameter of the shaft.

4. The arrow of claim 1, wherein the shaft is formed of a thin, flexible plastic.

5. The arrow of claim 4, wherein the flexible plastic forms a wall surrounding the hollow.

6. The arrow of claim 4, wherein the flexible plastic has a shape memory.

7. The arrow of claim 6, wherein the shape memory returns the shaft to an original shape after bending of the flexible plastic.

8. The arrow of claim 1, wherein the forward tip is flexible.

9. The arrow of claim 1, further comprising a plurality of fins.

10. The arrow of claim 9, wherein the plurality of fins are affixed at a predetermined spacing around an exterior of the shaft.

11. The arrow of claim 1, wherein a distal end of the nock is configured to receive a bowstring.

12. An arrow comprising:
a forward tip;
a rear tip;
a shaft consisting of a thin plastic that forms a hollow extending from the forward tip to the rear tip;
a nock positioned at the rear tip, wherein the shaft is configured to bend; and
a protrusion extending forward of the forward tip and rearward of the forward tip, thereby overlapping a portion of the shaft extending rearward of the forward tip,
wherein the thin plastic has a shape memory that returns the shaft to its original shape after bending, and
wherein the nock spans a diameter of the shaft.

13. An arrow comprising:
a shaft including a hollow;
a forward tip closing a first end of the shaft;
a rear tip closing a second end of the shaft opposite the first end; and
a protrusion extending forward of the forward tip,
wherein the shaft comprises a thin plastic with a shape memory that returns the shaft to its original shape after bending,
wherein the rear tip comprises a nock, and
wherein the protrusion extends rearward to overlap a portion of the shaft extending rearward of the forward tip.

14. The arrow of claim 13, wherein the protrusion is a soft foam.

* * * * *